US006287165B1

(12) United States Patent
Lin

(10) Patent No.: US 6,287,165 B1
(45) Date of Patent: Sep. 11, 2001

(54) JUMBO BUBBLE BLOWER TOY

(76) Inventor: Mon-Sheng Lin, 5th Fl., No. 4, Lane 7, Pao Kao Road, Hsintien, Taipei Hsien (TW)

( * ) Notice: Subject to any disclaimer, the term of this patent is extended or adjusted under 35 U.S.C. 154(b) by 0 days.

(21) Appl. No.: 09/532,745

(22) Filed: Mar. 22, 2000

(51) Int. Cl.[7] ..... A63H 33/28
(52) U.S. Cl. ..... 446/16
(58) Field of Search ..... 446/15, 16, 17, 446/18, 19, 20, 21; 40/408; D21/401, 402

(56) References Cited

U.S. PATENT DOCUMENTS

| | | | | |
|---|---|---|---|---|
| 2,836,926 | * | 6/1958 | Tseng . | |
| 5,183,428 | * | 2/1993 | Lin | 446/15 |
| 5,653,620 | * | 8/1997 | Lin | 446/15 |
| 5,839,936 | * | 11/1998 | Lin | 446/16 |
| 6,059,629 | * | 5/2000 | Lin | 446/15 |
| 6,093,075 | * | 7/2000 | Lin | 446/16 |
| 6,132,125 | * | 10/2000 | Lin | 401/195 |

* cited by examiner

*Primary Examiner*—Jacob K. Ackun, Jr.
*Assistant Examiner*—Faye Francis
(74) *Attorney, Agent, or Firm*—Dougherty & Troxell

(57) ABSTRACT

A jumbo bubble blower toy includes an elongated solution container holding a solution, and a bubble blowing device for insertion into the solution container to take the solution for blowing bubbles, the bubble blowing device including a bubble blowing unit and an operating unit, the bubble blowing unit having two long arms pivoted together and a folding arm pivotally connected between the two distal ends of the pivoted long arms for enabling the bubble blowing unit to be turned, by means of the operation of the operating unit, between a close position where the folding arm is folded up and the long arms are closely attached together, and an open position where the long arms and the folding arm are extended out, forming a triangular open frame for blowing jumbo bubbles, the operating unit including a handle having a shank pivoted to a pivot between two symmetrical halves of the folding arm for enabling the folding arm to be turned inwards toward each other to close the bubble blowing unit when the connecting area between the long arms of the bubble blowing unit is inserted into the solution container, or turned outwards to open the bubble blowing unit when the bubble blowing unit is removed from the solution container.

5 Claims, 8 Drawing Sheets

JUMBO BUBBLE BLOWER TOY

BACKGROUND OF THE INVENTION

The present invention relates to a bubble blower toy, and more particularly to a jumbo bubble blower toy, which improves the structure of the bubble-blower toy disclosed in U.S. patent application Ser. No. 09/166,706, now U.S. Pat. No. 6,093,075.

According to the design of U.S. patent application Ser. No. 09/166,706, the bubble-blower toy comprises an elongated solution container having a narrow opening, and a bubble-blowing device for insertion into the solution container to take a solution from the solution container for blowing jumbo bubbles. The bubble-blowing device comprises an operating unit, and a folding collapsible bubble-blowing unit. The operating unit drives the folding collapsible bubble-blowing unit between an open position where the operating unit forms a triangular open frame for blowing jumbo bubbles, and a closed position where the operating unit is collapsed for insertion into the solution container. However, because the operating unit is connected to the connecting point between the long arms of the bubble-blowing unit, linking means is necessary to let the bubble-blowing unit to be moved with the operating unit between the closed position and the open position. Further, before inserting the bubble-blowing device into the solution container, the bubble-blowing unit must be closed first.

SUMMARY OF THE INVENTION

The present invention provides a jumbo bubble blower toy, which eliminates the aforesaid problem. According to the present invention, the jumbo bubble blower toy comprises a bubble-blowing device and a solution container. The bubble-blowing device comprises an operating unit, and a folding collapsible bubble-blowing unit. The bubble blowing device comprises a bubble blowing unit and an operating unit, the bubble blowing unit having two long arms pivoted together and a folding arm pivotally connected between the two distal ends of the pivoted long arms for enabling the bubble blowing unit to be turned, by means of the operation of the operating unit, between a closed position where the folding arm is folded up and the long arms are close together, and an open position where the long arms and the folding arm are extended out, forming a triangular open frame for blowing jumbo bubbles. The operating unit comprises a handle having a shank pivoted to a pivot between two symmetrical halves of the folding arm for enabling the folding arm to be turned inwards toward each other to close the bubble blowing unit when the connecting area between the long arms of the bubble blowing unit is inserted into the solution container, or turned outwards to open the bubble blowing unit when the bubble blowing unit is removed from the solution container. This design enables the bubble-blowing unit to be directly inserted into the solution container before collapsing, and the bubble-blowing unit is automatically forced inwards and collapsed when inserted into the solution container.

DETAILED DESCRIPTION OF THE PREFERRED EMBODIMENT

Figure 1:
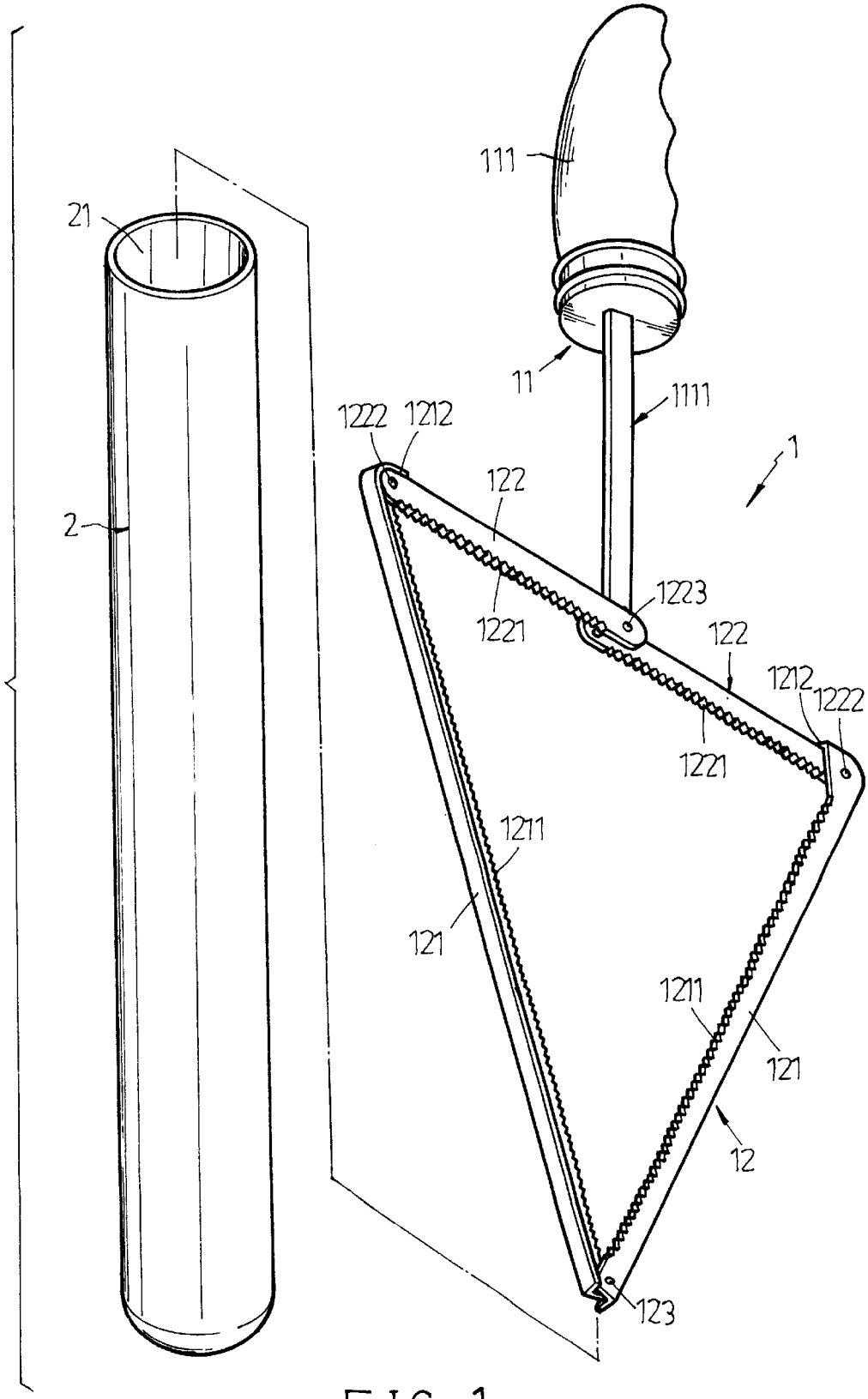
FIG. 1 is an elevational view of a jumbo bubble blower toy according to a first embodiment of the present invention, showing the bubble-blowing device taken out of the solution container and opened.
Figure 2:
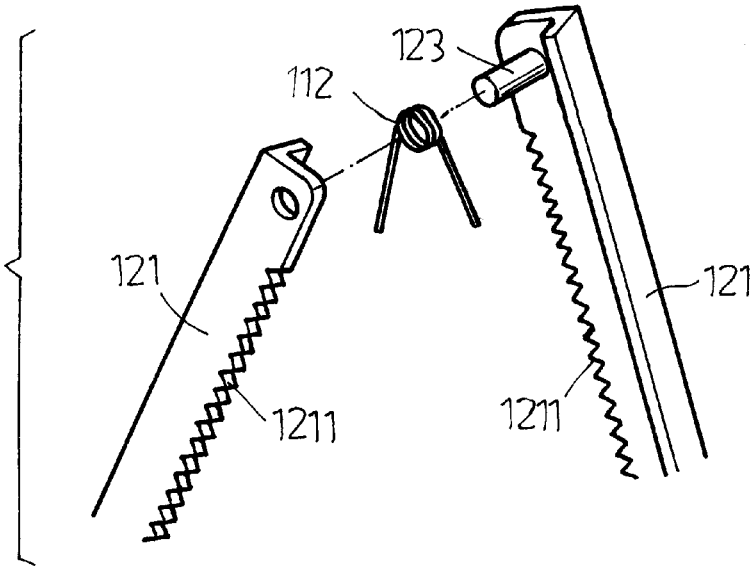
FIG. 2 is an exploded view of a part of the first embodiment of the present invention, showing the connection structure between the long arms of the bubble-blowing unit.

Referring to FIGS. from 1 through 9, a jumbo bubble blower toy in accordance with the present invention is generally comprised of a bubble-blowing device 1, and a solution container 2. The bubble-blowing device 1 is comprised of an operating unit 11, and a bubble-blowing unit 12. The solution container 2 is a narrow, elongated container holding a solution for producing bubbles, having an opening 21 at its one end through which the bubble-blowing unit 12 is inserted into the inside of the solution container 2 and dipped in the solution in the solution container 2.

The bubble-blowing unit 12 comprises two long arms 121, and a folding arm 122 pivotally connected between the long arms 121 at one end. The arms 121 and 122 each have a serrated portion 1211 or 1221 longitudinally disposed at an inner side. The long arms 121 are pivotally connected together by a pivot 123, and can be moved toward each other, defining a small contained angle, enabling the bubble-blowing unit 12 to be inserted through the opening 21 into the solution container 2 and dipped in the solution.

The folding arm 122 of the bubble-blowing unit 12 is comprised of two separate halves each having one end pivoted to the other by a pivot 1223 and an opposite end respectively pivoted to the long arms 121 by a respective pivot 1222. When the two separate halves of the folding arm 122 are folded up, the two long arms 121 are moved close to each other (see FIGS. 5 and 6). At this time, the bubble-blowing unit 12 can be conveniently inserted into the solution container 2 and dipped in the solution.

Figure 4:
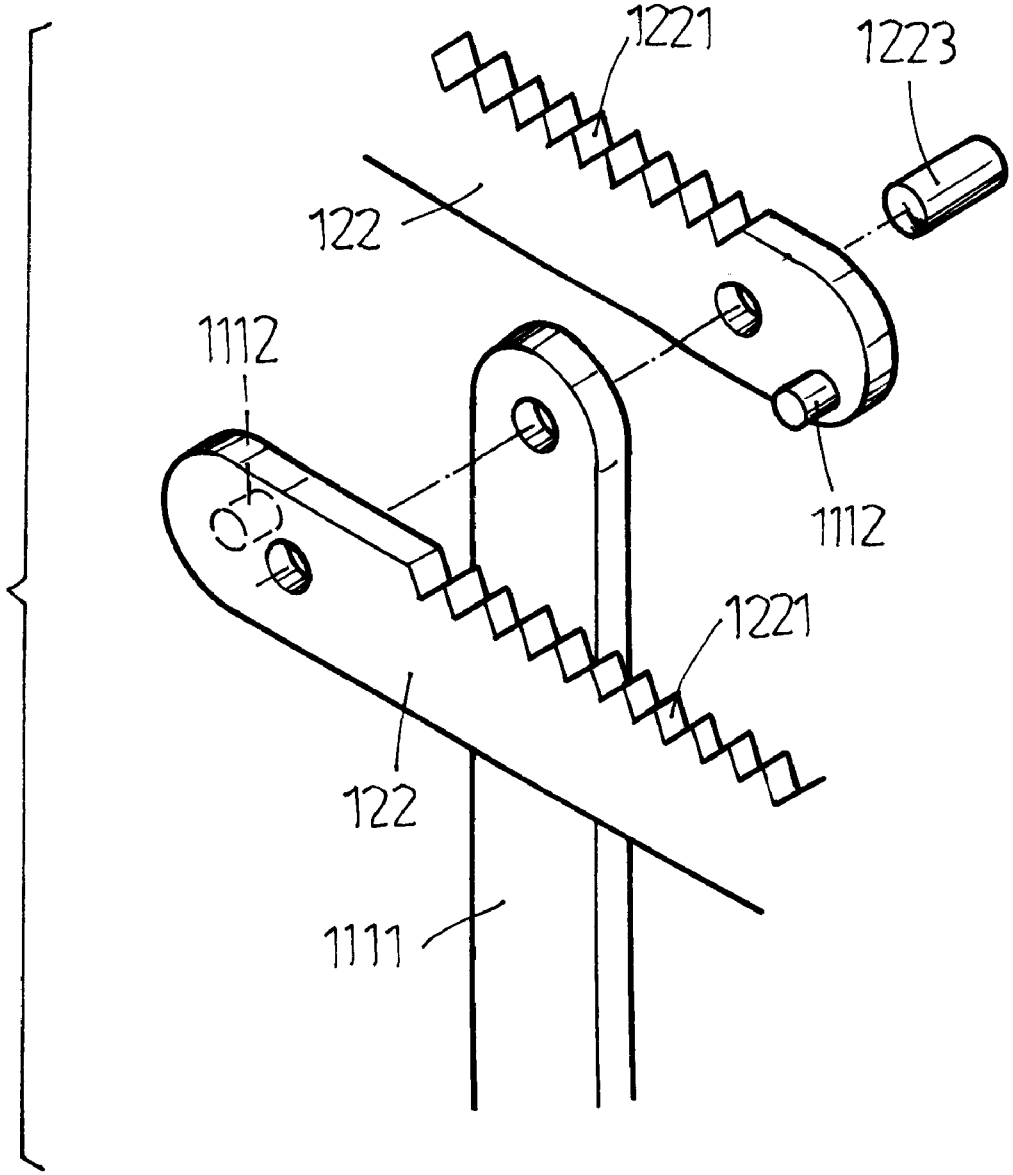
FIG. 4 is an exploded view of a part of the first embodiment of the present invention, showing the connecting structure between the shank of the handle and the folding arm of the bubble-blowing unit.

Referring to FIGS. from 1 through 6, the operating unit 11 comprises a handle 111, and a torsional spring 112. The handle 111 comprises a shank 1111 pivoted to the pivot 1223 at the folding arm 122. The folding arm 122 comprises a stop rod 1112 at each half thereof to limit the turning angle (see FIGS. 1 and 4). The torsional spring 112 is mounted on the pivot 123 and connected between the long arms 121 of the operating unit 11 to stretch open the long arms 121.

Figure 3:
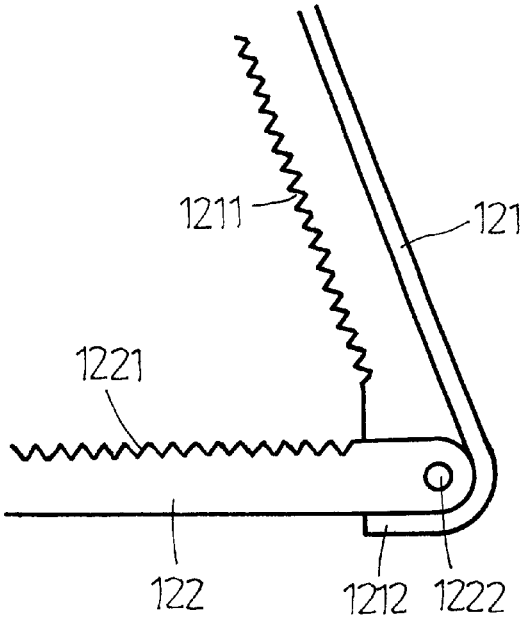
FIG. 3 is an assembly view of FIG. 2.
Figure 7:
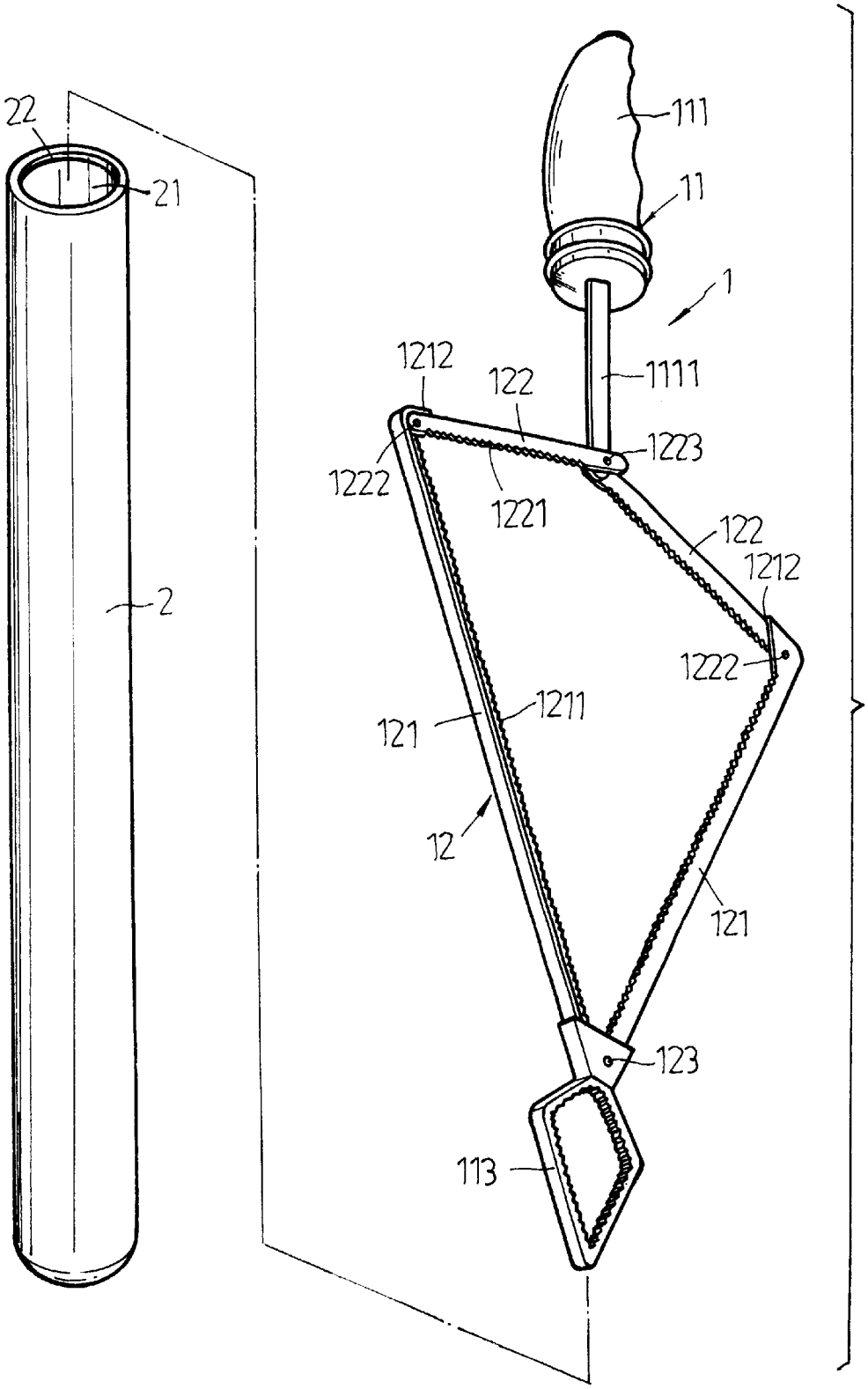
FIG. 7 is an elevational view of a jumbo bubble blower toy according to a second embodiment of the present invention, showing the bubble-blowing device taken out of the solution container and opened.

Referring to FIGS. 1, 3 and 7, the long arms 121 each have a stop flange 1212 for limiting the turning angle of the bubble-blowing unit 12. For example, the bubble-blowing unit 12 of the embodiment shown in FIG. 1 shows the shape of a triangular open frame when opened; the bubble-blowing unit 12 of the embodiment shown in FIG. 7 shows the shape of a rhombic open frame when opened.

Figure 5:
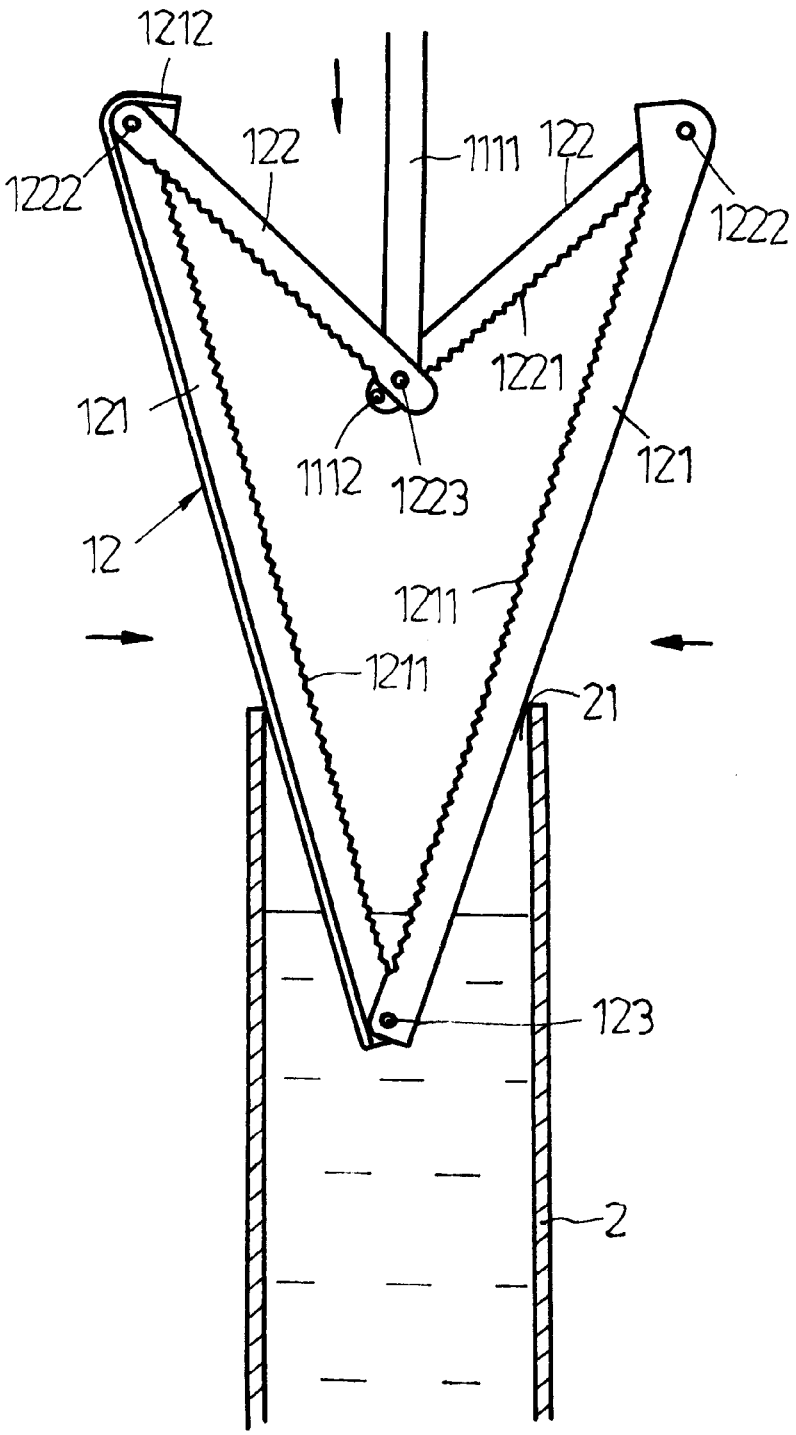
FIG. 5 is a schematic drawing showing the connecting area between the long arms of the bubble-blowing unit of the first embodiment inserted into the solution container according to the present invention.
Figure 6:
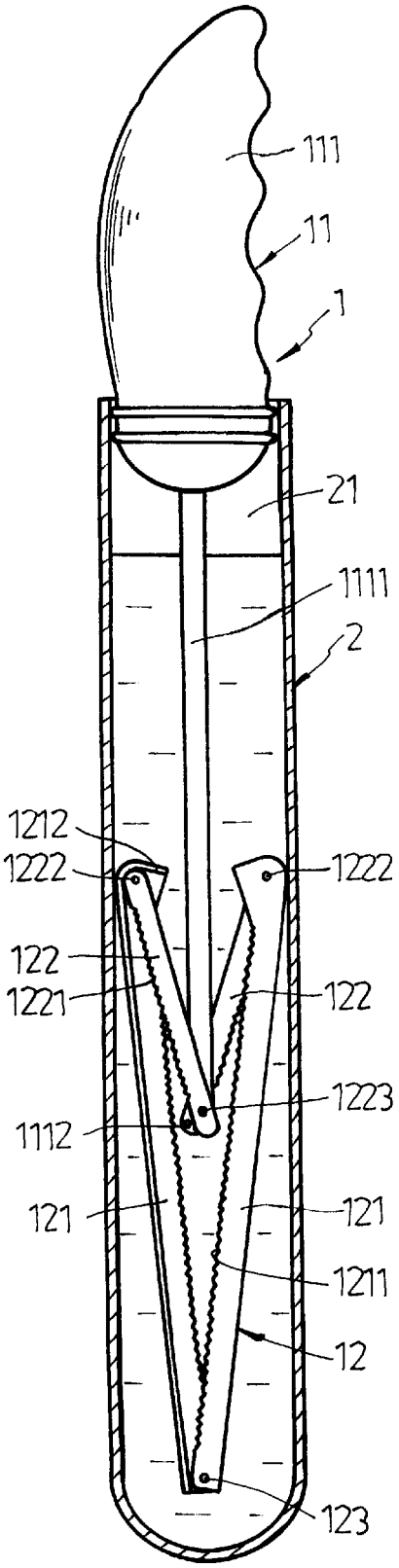
FIG. 6 is a side view of the present invention, showing the bubble-blowing device collapsed and inserted into the solution container.

Referring to FIGS. 5 and 6, when inserting the bubble-blowing unit 12 into the solution container 2, the folding arm 122 is forced by the handle 111 and folded inwards, enabling the long arms 121 to be closed together and forced into the inside of the solution container 2.

Referring to FIG. 1, when the bubble-blowing unit 12 is moved away from the solution container 2, the long arms 121 is immediately stretched open by the spring force of the torsional spring 112.

Figure 8:
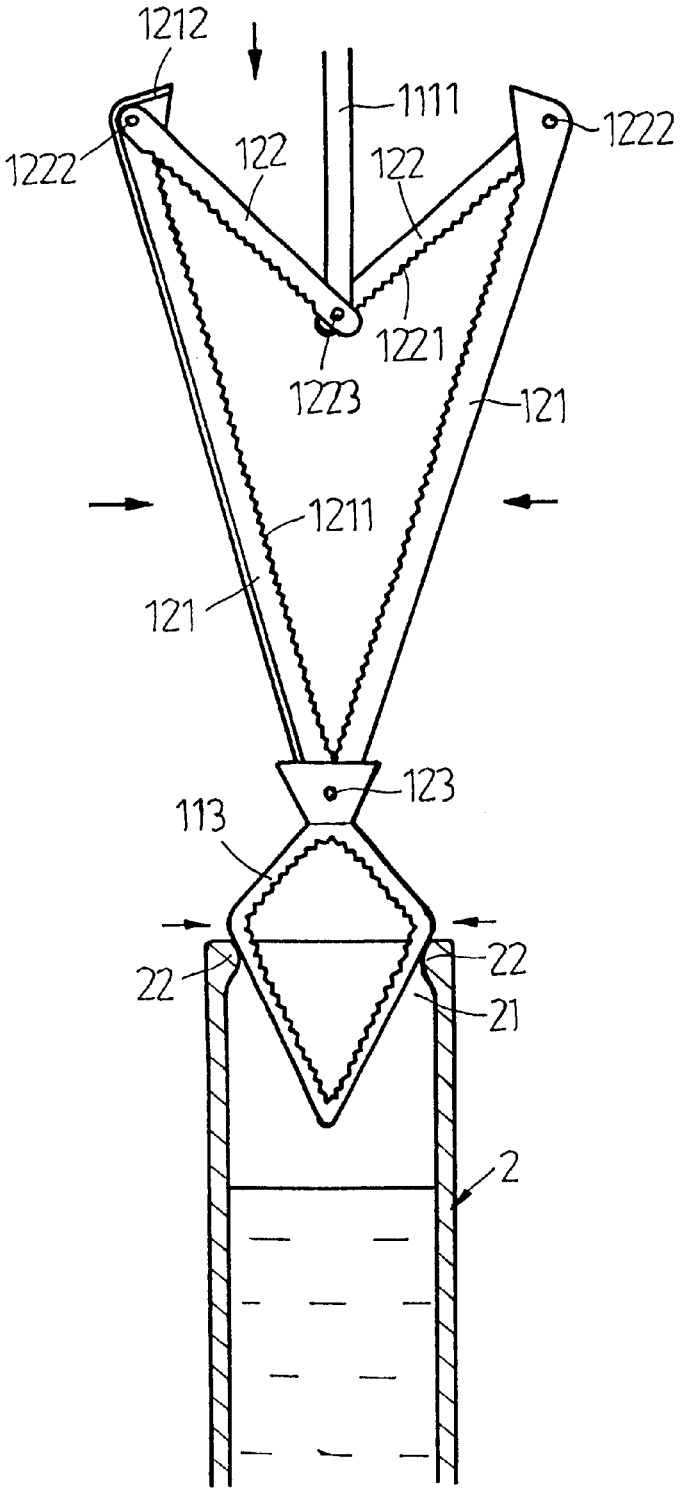
FIG. 8 is a schematic drawing showing the connecting area between the long arms of the bubble-blowing unit of the second embodiment of the present invention inserted into the solution container, the folding arm folded inwards.
Figure 9:
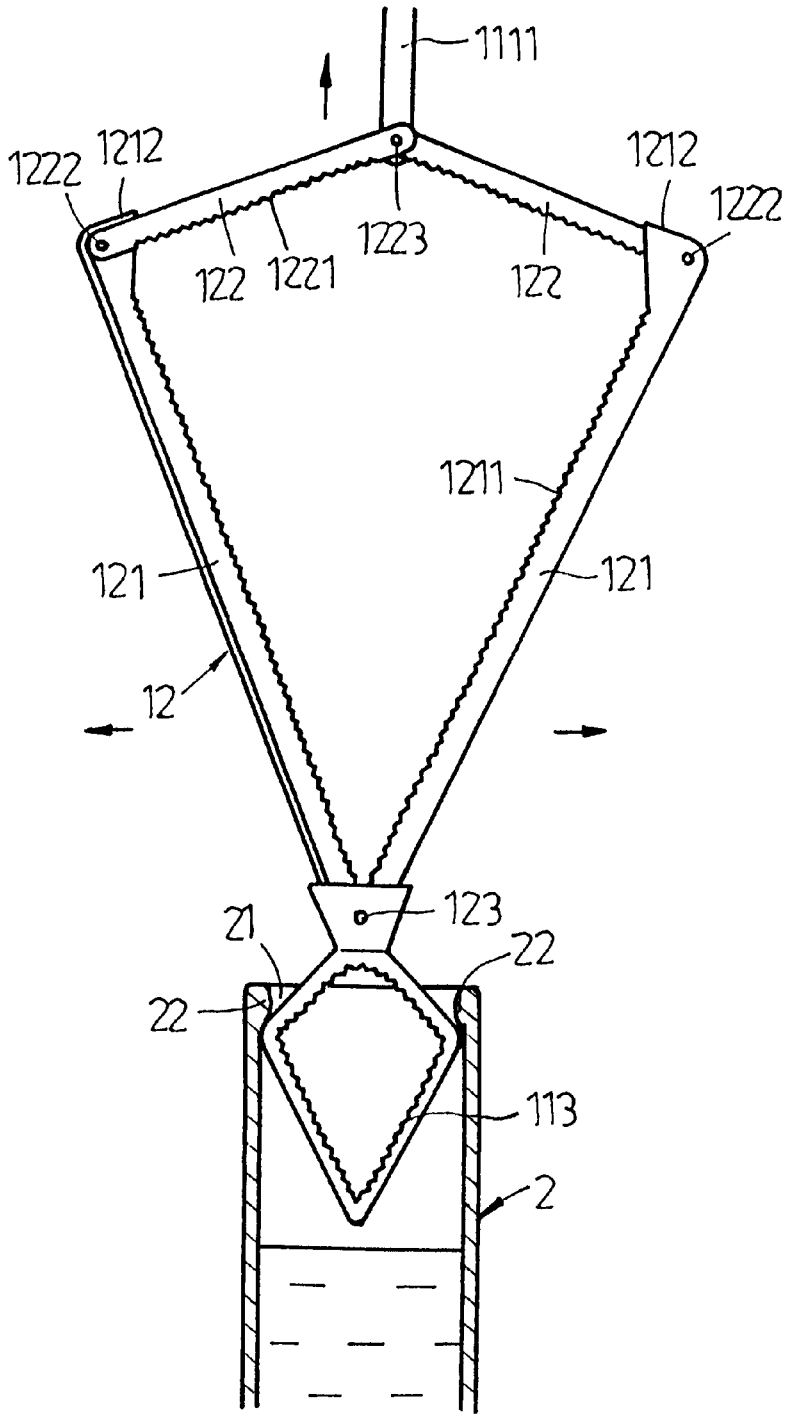
FIG. 9 is a schematic drawing showing the handle of the jumbo bubble blower toy of the second embodiment of the present invention pulled outwards, the bubble blowing unit moved out of the solution container, the long arms extended outwards.

Referring to FIGS. from 7 through 9, a flexible bubble coil 113 is fastened to the pivot 123 between the long arms 121 remote from the folding arm 122. The flexible bubble coil 113 has a narrow front end convenient for entering the solution container 2 (see FIG. 8). The solution container 2 has an inside annular flange 22 around the opening 21 (see FIG. 9). When the bubble-blowing device 1 is pulled outwards from the solution container 2, flexible bubble coil 113 is stopped at the inside annular flange 22, enabling the folding arm 122 to be pulled by the operating unit 11 to the extended position. The flexible bubble coil 113 is disengaged from the inside annular flange 22 when continuously pulling the handle 11 outwards after the folding arm 122 has been extended out.

As illustrated in FIGS. from 1 through 9, the bubble-blowing unit 12 can be closed and inserted through the opening 21 into the inside of the solution container 2 to take the solution. After having been pulled out of the solution container 2, the bubble-blowing unit 12 is forced to open by the spring power of the torsional spring 112, enabling adhered solution to be blown into jumbo bubbles.

What the invention claimed is:

1. A bubble blowing toy comprising:

a) a solution container holding a solution, the container having an opening; and, b) a bubble blowing device having:

i) a pair of elongated arms having first ends pivotally connected together, and second ends, the elongated arms being movable about the pivotally connected first ends between a closed position, wherein the elongated arms are adjacent to each other, and an open position, wherein the second ends are spaced apart;

ii) a folding arm comprising first and second portions, each portion having a first end pivotally connected to the second end of one of the elongated arms, and second ends pivotally connected to each other, each second end having a stop rod located so as to contact the other portion of the folding arm such that the first and second portions are linearly aligned when the pair of elongated arms are in their open position, and the pair of elongated arms and the folding arm form a triangular configuration;

iii) an operating unit having a handle and connected to the folding arm at the pivotally connected second ends of the first and second portions; and iv) a torsion spring acting on the pair of elongated arms so as to bias the pair of elongated arms to their open position, whereby a force exerted by the handle urging the bubble blowing device into the solution container causes the first and second portions of the folding arm to pivot about their first ends toward the associated elongated arms, enabling the elongated arms to move to the closed positions and enter the solution container.

2. The bubble blowing toy of claim 1 further comprising a stop flange extending from each elongated arm and located so as to contact the associated first and second portions of the folding arm to limit the relative turning angle between the elongated arms and the folding arm.

3. The bubble blowing toy of claim 1 further comprising serrations formed on inner sides of the elongated arms and the folding arm.

4. The bubble blowing toy of claim 1 further comprising a flexible bubble coil mounted on a pivot connection pivotally connecting the first ends of the pair of elongated arms, the flexible bubble coil having a closed geometric configuration.

5. The bubble blowing toy of claim 4 wherein the solution container further comprises an inside annular flange around the opening.

* * * * *